US009940795B2

(12) United States Patent
Van Linden

(10) Patent No.: US 9,940,795 B2
(45) Date of Patent: Apr. 10, 2018

(54) TOROIDAL VIRTUAL REELS FOR SLOT MACHINES

(71) Applicant: Lucien M. Van Linden, Maasland (NL)

(72) Inventor: Lucien M. Van Linden, Maasland (NL)

(73) Assignee: GAMING SUPPORT B.V., Rotterdam (NL)

( * ) Notice: Subject to any disclaimer, the term of this patent is extended or adjusted under 35 U.S.C. 154(b) by 0 days.

(21) Appl. No.: 14/733,901

(22) Filed: Jun. 8, 2015

(65) Prior Publication Data

US 2015/0269815 A1 Sep. 24, 2015

Related U.S. Application Data

(63) Continuation of application No. 12/813,874, filed on Jun. 11, 2010, now abandoned.

(51) Int. Cl.
*G07F 17/34* (2006.01)
*G07F 17/32* (2006.01)

(52) U.S. Cl.
CPC ..... *G07F 17/34* (2013.01); *G07F 17/3213* (2013.01); *G07F 17/3272* (2013.01)

(58) Field of Classification Search
CPC ..... G07F 17/32; G07F 17/3213; G07F 17/34
USPC ..... 463/16, 21, 31, 32
See application file for complete search history.

(56) References Cited

U.S. PATENT DOCUMENTS

| | | | | |
|---|---|---|---|---|
| 5,362,052 | A | 11/1994 | Kubatsch | |
| 5,462,277 | A | 10/1995 | Takemoto | |
| 6,186,894 | B1 | 2/2001 | Mayeroff | |
| 7,179,169 | B2 | 2/2007 | Beaulieu et al. | |
| 7,252,591 | B2 | 8/2007 | Van Asdale | |
| 7,425,177 | B2 | 9/2008 | Rodgers et al. | |
| 2003/0153385 | A1 * | 8/2003 | Ikeya | G07F 17/32 463/31 |
| 2004/0102244 | A1 * | 5/2004 | Kryuchkov | G07F 17/32 463/32 |
| 2007/0060255 | A1 | 3/2007 | Baerlocher et al. | |
| 2008/0026848 | A1 * | 1/2008 | Byng | G07F 17/32 463/42 |
| 2008/0182647 | A1 * | 7/2008 | Brunet De Courssou | G07F 17/3211 463/20 |
| 2009/0124342 | A1 * | 5/2009 | Fong | G07F 17/34 463/20 |

* cited by examiner

*Primary Examiner* — Lawrence Galka
(74) *Attorney, Agent, or Firm* — Nixon & Vanderhye PC

(57) ABSTRACT

A gaming system comprising a spheroid object, a surface of which is provided with a plurality of symbols, gaming means for causing the spheroid object to rotate along at least three separate axes of rotation, display means for displaying symbols provided on a part of the surface of the spheroid object as rotated by the gaming means in a display area of the gaming system, and win determination means for evaluating a winning condition from those symbols of that are visible in the display area along at least one win line.

11 Claims, 6 Drawing Sheets

TOROIDAL VIRTUAL REELS FOR SLOT MACHINES

CROSS-REFERENCE

This application is a continuation of commonly owned copending U.S. application Ser. No. 12/813,874 filed Jun. 11, 2010, the entire contents of which are hereby expressly incorporated herein by reference.

FIELD OF THE INVENTION

The invention relates to a gaming system where players may place a wager on particular randomly selected symbol arrangements on plural objects.

BACKGROUND OF THE INVENTION

Many types of gaming systems exist that let players place a wager on particular randomly selected symbol arrangements. The most common examples of these types are the so-called slot machines or fruit machines. Slot machines present several wheels or strips with symbols on them in a display area such as a computer screen. After rotating the wheels or strips, or after otherwise changing the visible parts of the wheels or strips in the display area for a certain time, the symbols currently visible in the display area present certain combinations along certain lines, known as pay lines or win lines. For example, if three symbol carriers each show a symbol of a lemon on the win line, the player wins a monetary prize. Two lemons and one dog face may award the player a smaller prize or no prize at all. US2007/0060255 discloses an alternative where winnings are not determined using pay lines.

Many variations of this type of gaming machine exist, all with the aim of increasing player enjoyment and to encourage more playing. For example, in U.S. Pat. No. 7,252,591, the symbol carriers each comprise a set of symbols as usual. However, some symbols may be provided in the form of a symbol stack that includes an initially displayed symbol and at least one initially hidden symbol. A player can then choose to remove the initially displayed symbol and instead play with the initially hidden symbol. In U.S. Pat. No. 5,462,277 the symbol carriers are embodied as three rotating drums, each with an outer peripheral surface on which a plurality of symbols are shown, which surface is rotatable around a single, joint axis. The drums appear to form a spherical shape in combination.

U.S. Pat. No. 5,362,052 discloses a drive mechanism with a symbol-carrying, rotary symbol carrier, particularly for use in coin-operated gaming machines. The drive mechanism for the symbol carrier is a motor-gear combination, which drives the symbol carrier in such a way that it rotates about two rotation axes. In an embodiment the symbol carrier is a die, and the mechanism allows the symbol carrier to be positioned to display any of the six faces of the die.

This type of gaming machine may be provided with a bonus gaming device, allowing the player to play the bonus game if he achieves a particular result in the main game. In U.S. Pat. No. 7,179,169 an electronic bonus game of this type is disclosed. An image of a rotating wheel is presented, which rotating wheel has several sections with respective symbols displayed thereon. The orientation of each symbol image is adjusted as the wheel rotates.

The performance or chances of the bonus game may be made dependent on the result in the main game. For example, U.S. Pat. No. 6,186,894 discloses a main game comprising a multi-reel payline mechanical reel or video reel slot arrangement with at least one payline and a secondary event game comprising a multi-reel, one or more payline mechanical slot arrangement. Whenever the player achieves a combination of symbols on the main game that awards the player with the secondary event game, the number of chances provided to the player to play the secondary event game is based on the number of paylines that the player has played on the main game or by the number of credits wagered on each payline.

In U.S. Pat. No. 7,425,177 multiple interacting independently operated wheels are provided. Each wheel includes a plurality of sections that are associated with a plurality of different outcomes which are displayed to a player. One or more of the wheels are rotated along a given axis, either sequentially or simultaneously and the results of the wheel activations influence one or more subsequent wheel activations. Upon a terminating event, an outcome based on the results from one or more spins of one or more of the wheels are provided to the player.

Such gaming machines may embody the symbol carriers as physical reels or wheels that rotate along a physical axis, or as virtual reels generated as computer images and displayed on the display area which is embodied as a display screen. US2004/0102244 discloses an embodiment of the latter type. Virtual reels as shown here are used as they are not limited by the constraints of actual mechanical slot reels.

The above gaming systems still suffer from limitations inherent in their construction. A new approach is necessary to overcome these limitations and provide an improved gaming system that can significantly enhance game experience for players.

SUMMARY OF THE INVENTION

The invention provides for an improved gaming system comprising a spheroid object, a surface of which is provided with a plurality of symbols, gaming means for causing the spheroid object to rotate along at least three separate axes of rotation, display means for displaying symbols provided on a part of the surface of the spheroid object as rotated by the gaming means in a display area of the gaming system, and win determination means for evaluating a winning condition from those symbols of that are visible in the display area along at least one win line. In an embodiment multiple spheroid objects are employed.

By employing one or more spheroid objects rather than discs and rotating the object(s) along at least three separate axes of rotation, the possibilities for generating new potentially winning combinations increase significantly, thus enhancing game experience. Furthermore, rotation along three or more axes provides for a much more attractive visualization of the game, compared to the traditional single axis that a gaming system with reel or wheel provides.

In an embodiment the spheroid object is embodied as a virtual object stored in computer memory and displayed on the display area by a rendering means that renders a computer-generated visualization of the object. Alternatively the spheroid object is embodied as a physical object, e.g. as a plastic ball.

In a variation of this embodiment the display means comprise symbol adjustment means for adjusting an orientation of the symbols on the displayed part of the spheroid object relative to the rotation caused by the gaming means. Normally, to simulate the appearance of a virtual spheroid objects as a real-life object, symbols that are not directly in front of the player would be shown in distorted fashion due to the rotation necessary to create the appearance of a real-life globe or other spheroid object. In this advantageous embodiment, such symbols would be subjected to an adjusted rotation to restore their original appearance to improve visibility of the symbols.

In another embodiment the spherical object is in a toroidal shape and at least one of the at least three separate axes is the axis of revolution. A torus provides for a wide variety of possibilities of rotation. Alternatively the spherical objects may be in the shape of a sphere or globe.

The invention further provides for a gaming arrangement comprising plural gaming systems in accordance with the invention, where each display area of each of the plural gaming systems presents a different part of the spheroid object or objectss. Preferably in this arrangement at least some of the at least one win lines run through plural display areas.

The invention further advantageously provides a computer program product comprising machine-executable instructions to enable a programmable device to implement the invention. The program product comprises gaming means for causing a spheroid object, a surface of which is provided with a plurality of symbols, to rotate along at least three separate axes of rotation, display enabling means for causing display means to display symbols provided on a part of each spheroid object as rotated by the gaming means in a display area of a gaming system, and win determination means for evaluating a winning condition from those symbols of the spheroid object that are visible in the display area along at least one win line. The product is preferably recorded on a storage medium such as a semiconductor memory device, magnetic disk, magneto-optical disks and CD-ROM disks. The product may also be offered as a web-based version, that is running on a server and having the display enabling means configured for causing the display means to display the symbols in a display area of a remote client connected to the server over a network.

BRIEF DESCRIPTION OF THE FIGURES

The invention will now be elaborated upon with reference to the figures, in which FIG. 1 schematically shows a gaming system, allowing playing of a game involving three spheroid objects.

DETAILED DESCRIPTION

Figure 1:
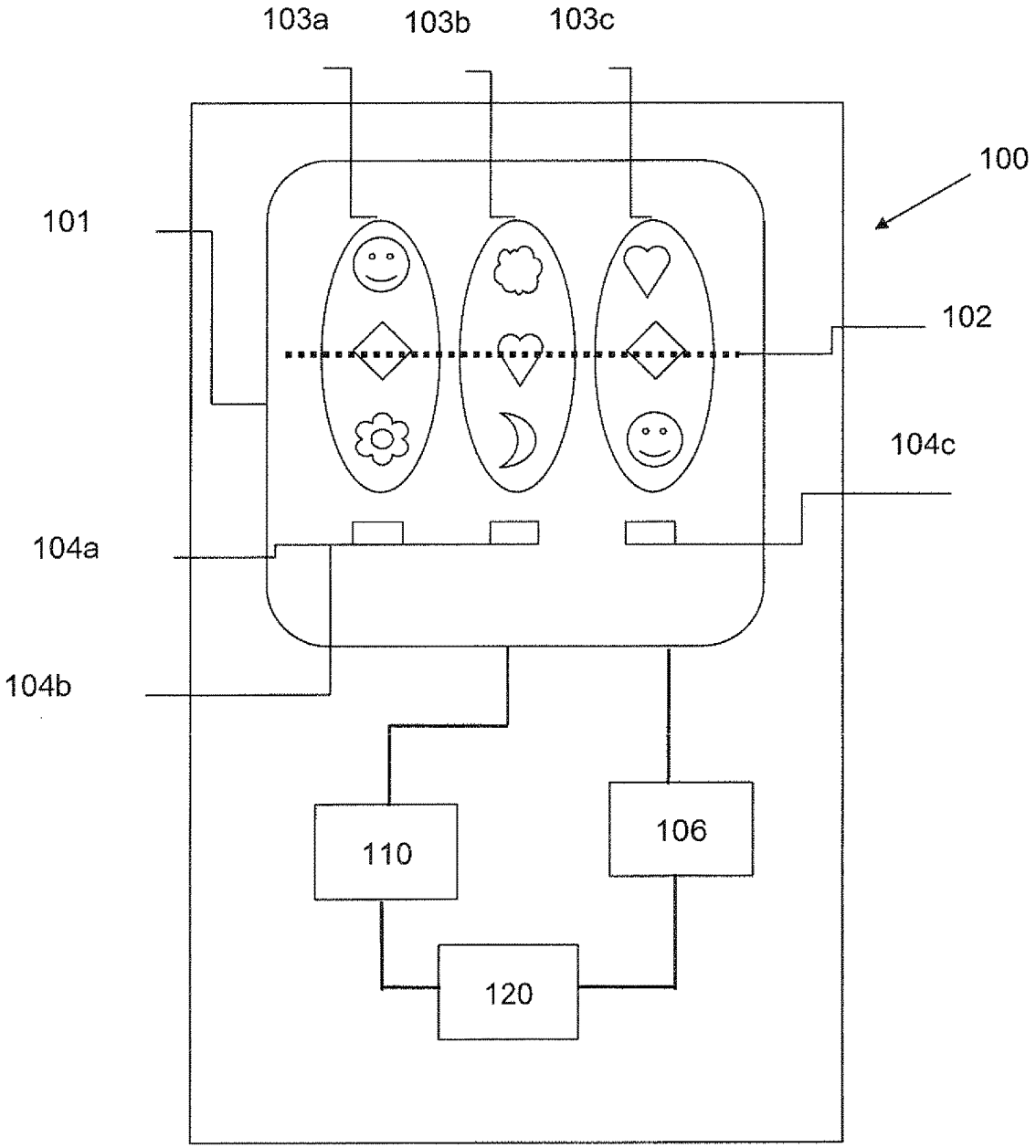

FIG. 1 schematically shows a gaming system 100 in accordance with the invention. While the invention can be used with any number of spheroid objects, the embodiment shown in FIG. 1 allows playing of a game involving three spheroid objects 103*a*, 103*b*, 103*c*. This embodiment has the advantage that three spheroid objects resembles the appearance of the well-known slot machines or fruit machines.

The respective surfaces of the spheroid objects 103*a*, 103*b*, 103*c* are provided with respective pluralities of symbols, which must be arranged along win line 102 in display area 101 in particular patterns to provide a winning outcome. A round in the game involves randomly selecting certain symbols from the spheroid objects 103*a*, 103*b*, 103*c* and displaying those in the display area 101. The selection is achieved by means of a rotating module 106 which causes each of the the spheroid objects 103*a*, 103*b*, 103*c* to rotate along at least three separate axes of rotation.

Figure 2:
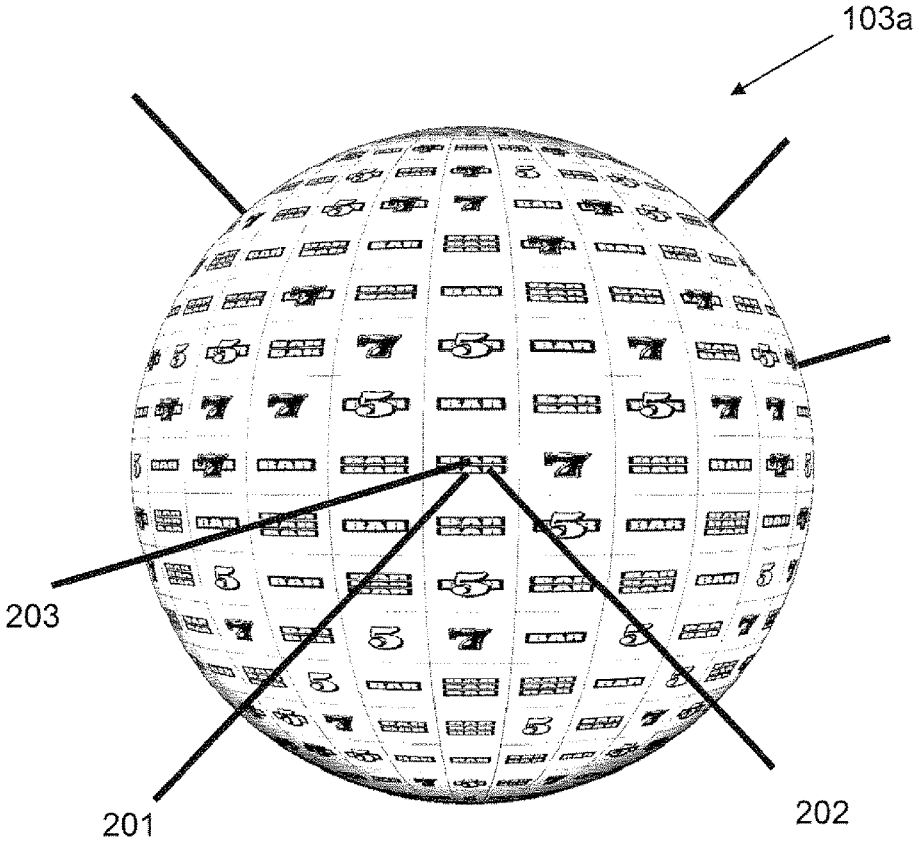
FIG. 2 illustrates a further embodiment for a spheroid object as a globe.

An example of such choice of axes is illustrated in FIG. 2 for spheroid object 103*a*, shown there as a globe with three axes 201, 202, 203 therethrough. All three axes stretch through the center of the globe and thus provide for easy rotation.

Figure 3:
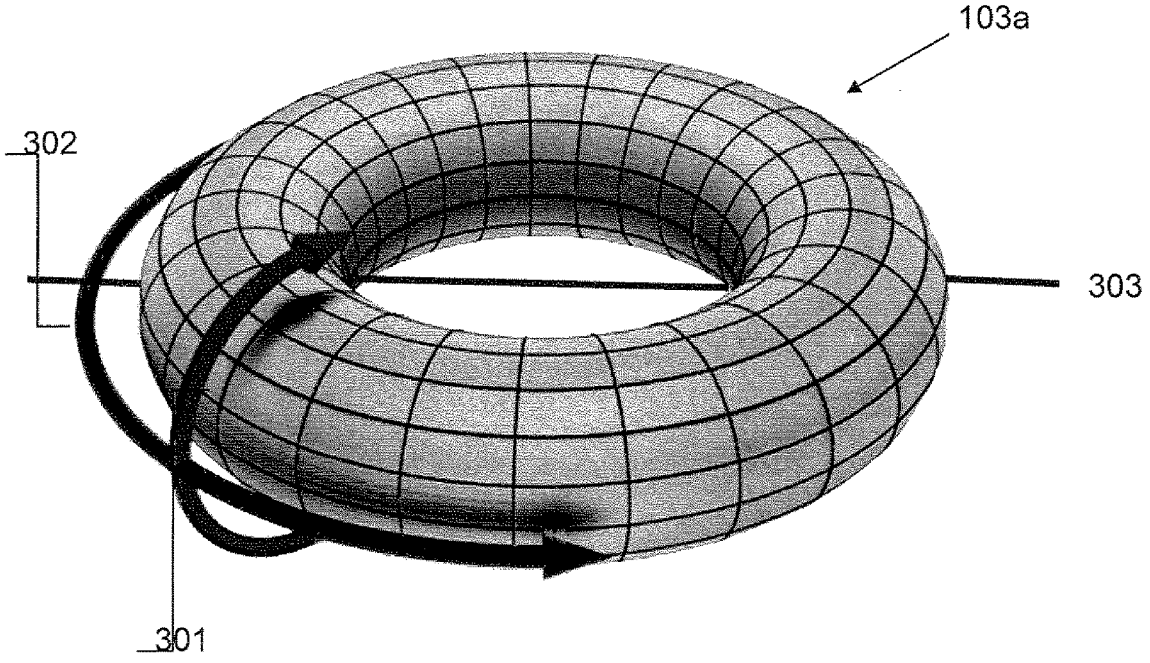
FIG. 3 illustrates a further embodiment for a spheroid object as a torus.

Preferably the spherical objects 103*a*, 103*b*, 103*c* are in a toroidal shape, as in FIG. 3 where spheroid object 103*a* is embodied as a torus. Three axes of rotation are shown again. Axes 301 and 302 are both axes of revolution. Axis 303 is an axis of rotation through the center of the torus.

Figure 4A:
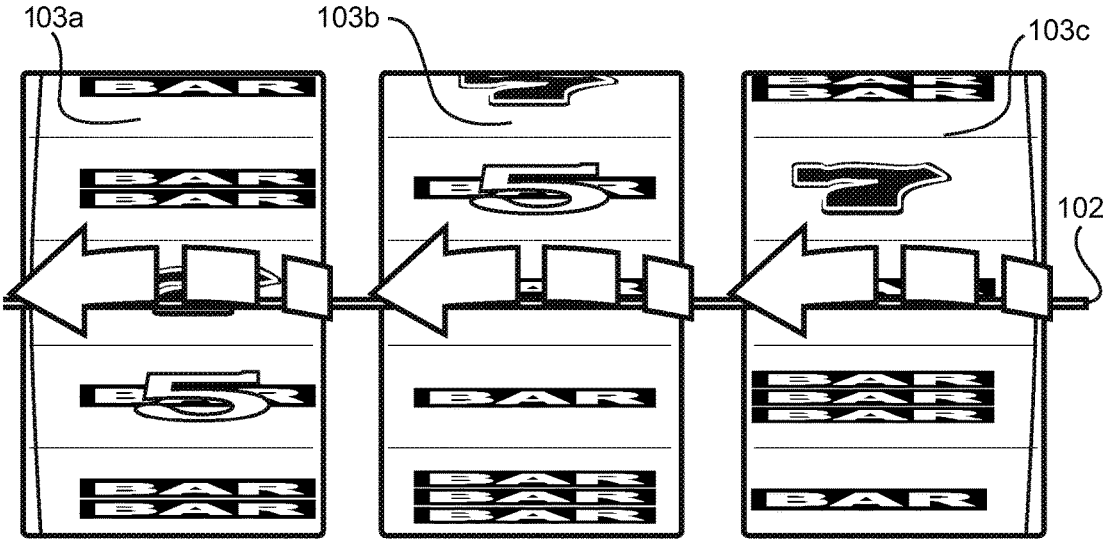
FIGS. 4*a* and 4*b* illustrate an embodiment of toroidal spheroid objects as they could appear in a display area of the gaming system of FIG. 1.
Figure 4B:
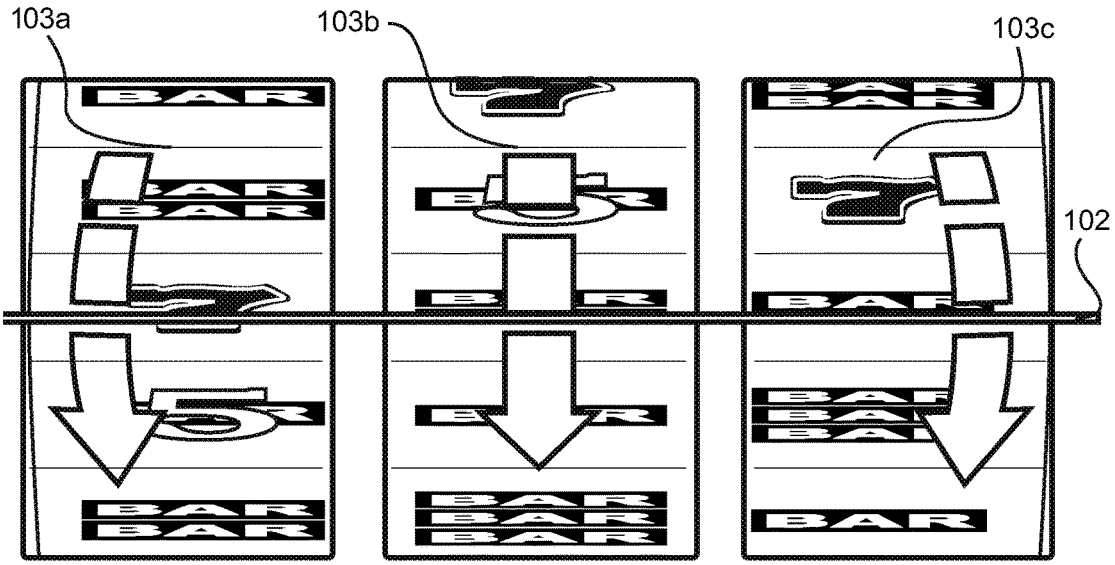

FIGS. 4*a* and 4*b* illustrate an embodiment of toroidal spheroid objects 103*a*, 103*b*, 103*c* as they could appear in the display area 101. The grey arrow in FIG. 4*a* illustrates rotation along axis 301, while the gray arrow in FIG. 4*b* illustrates rotation along axis 302.

Rotation along the axes of each object 103*a*, 103*b* 103*c* may occur in any order and may even be varied over time. For example the object 103*a* may first rotate along axis 301 for some seconds, then along axis 302 for some more seconds, then along axis 301 again and finally along axis 303 for a few seconds. In the meantime objects 103*b* and 103*c* may rotate along these axes in different orders altogether. The direction, e.g. left to right or north to south, of rotation may be varied over time as well. Alternatively all objects 103*a*, 103*b*, 103*c* may rotate along the same axes in the same order and direction.

The order and duration of each rotation may itself vary over time or be tied to other events. For example the order and/or duration may change with every new game, new round or new player that uses the gaming system 100. The change may occur as a result of the player losing, or alternately winning, a game or round. The number of axes involved may be made dependent on a level of the game, for example three axes for an easy or cheap game and ten axes for a difficult or more expensive game.

Figure 5:
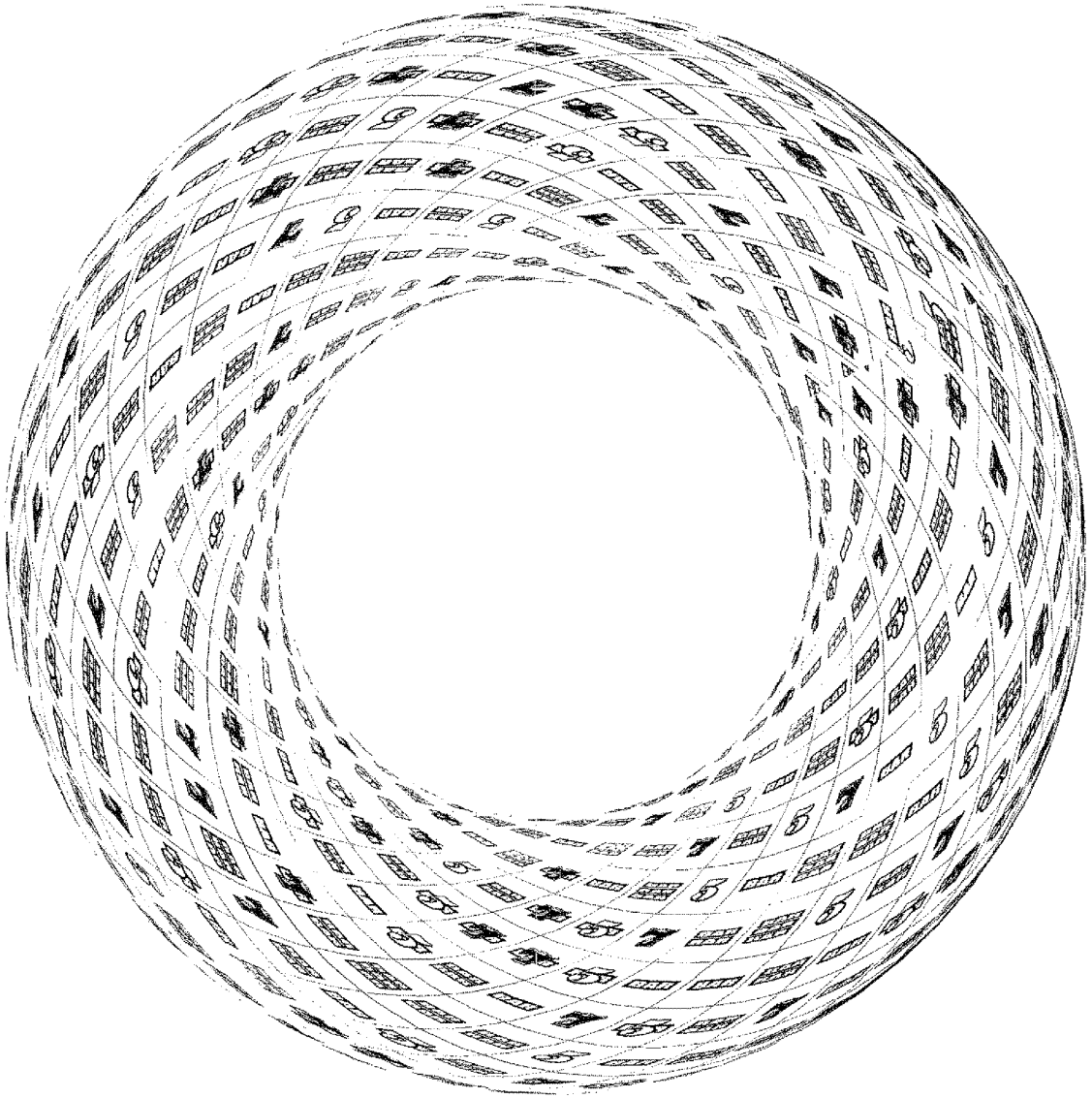
FIG. 5 illustrates an alternative embodiment for a spheroid object as a torus.

FIG. 5 illustrates an alternative embodiment for a spheroid object as a torus. In FIG. 5, the symbols are distributed over the surface of the torus as strips that do not coincide with the axes of rotation. Rotating along e.g. axis 301 or 302 then produces a more fanciful effect in display area 101.

In embodiments where the spheroid objects are virtual spheroid objects generated as computer images, the selection is accompanied by a fanciful display, for example by providing an animated view of the spheroid objects in simulated rotation. While no actual rotation takes place in such embodiments, this disclosure will still use the phrase "rotate" to indicate the operation in question. If the spheroid objects 103*a*, 103*b*, 103*c* are embodied as physical balls or globes, the selection may be executed by actually rotating the balls over the chosen axes for a certain period.

Returning to FIG. 1, the player can elect to "hold" one or more of the spheroid objects 103*a*, 103*b*, 103*c* by using hold buttons 104*a*, 104*b*, 104*c* respectively. Symbols selected from held spheroid objects remain unchanged between rounds for as long as they are held.

Optionally, the gaming system 100 further comprises a payment module (not shown) through which the user must provide payment in order to be allowed to play the game. This payment module can be implemented e.g. as a coin or paper money slot or a credit card reader. The gaming system 100 may be configured to deliver an amount of money, e.g. from the payment module or from a separate jackpot, a prize or in-game enhancements if the player has selected one or more win lines that pass through a winning combination of symbols from the spheroid objects 103*a*, 103*b*, 103*c*.

The gaming system 100 is kept simple to keep the disclosure brief. The skilled person will understand that many, many variations in the gaming system 100 are possible, for example by using only one or two or more than three spheroid objects, providing multiple or more complex win line arrangements, adding secondary games, multi-machine games or bonus games, and so on.

The gaming system 100 comprises a presentation module 110 which is configured to present selected symbols from the symbol spheroid objects 103*a*, 103*b*, 103*c* in the display area 101 after rotation by the rotating module 106. In the example of FIG. 1, three symbols from each spheroid object are selected and presented.

The gaming system 100 further comprises an outcome determination module 120 which is configured to determine an outcome of a particular game. The outcome is determined from those symbols from the spheroid objects 103*a*, 103*b*, 103*c* that are positioned along the win line or win lines in the display area 101 that the player has selected. Those symbols will be referred to as "win line symbols" below. In the example shown in FIG. 1, the player would win if the symbols underneath the win line 102, i.e. diamond-heart-diamond, form a winning combination. Whether this is the case, depends on how the module 120 is configured, which is well within the capabilities of the skilled person.

If the symbols appearing underneath one or more win lines selected by the player match a winning combination, the player wins the game and may receive a monetary amount or other prize, for example a car, a boat or electronic equipment, credits for further playing or in-game enhancements such as more powerful weapons, extra lives or access to special levels or challenges. The amount or prize may increase in value if the player has selected multiple win lines that match a winning combination.

In one embodiment, the spheroid objects 103*a*, 103*b*, 103*c* are provided as physical balls, preferably in the shape of a sphere. The symbols are then printed on the balls. The display area 102 then provides a view on the balls as they rotate and come to a stop.

In another embodiment, the spheroid objects 103*a*, 103*b*, 103*c* are embodied as virtual objects stored in computer memory and displayed on the display area by a rendering means that renders a computer-generated visualization of the objects. An advantage of this embodiment is that virtual objects in computer memory can be much larger than physical balls with symbols printed thereon. One may even vary the composition of the symbols on the surfaces of the spheroid objects from time to time, for example increasing or decreasing odds of winning combinations.

In embodiments where the objects 103*a*, 103*b*, 103*c* are virtual objects, it may be advantageous to equip the presentation module 110 with the ability to adjust an orientation of the symbols on the displayed parts of each spheroid object relative to the rotation caused by the rotating module 106. The adjustment restores any distortion caused by the rotation by module 106 so that the original rotation and appearance of the symbols is restored. FIG. 2 for example shows all symbols in their proper orientation.

Figure 6A:
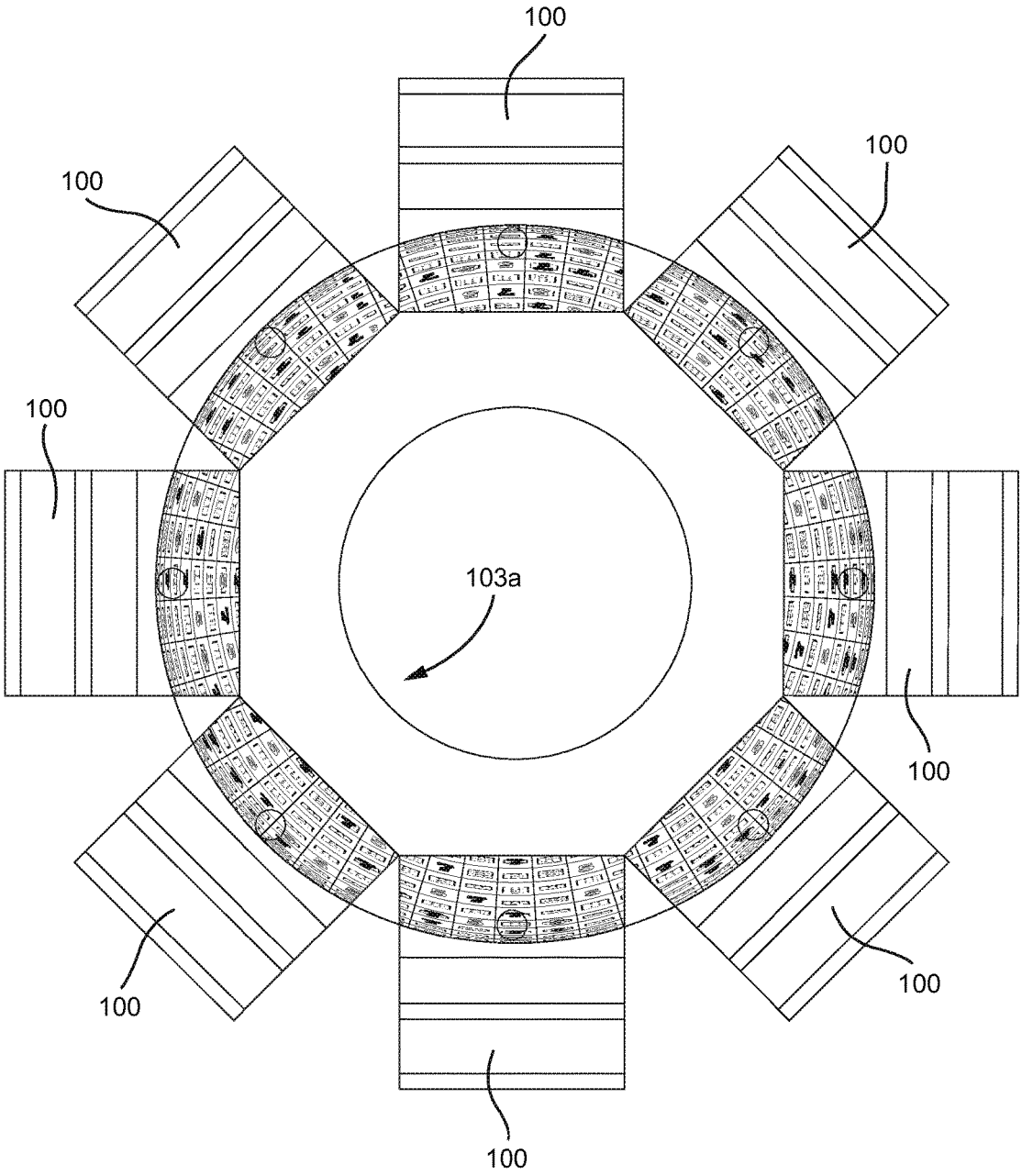
FIGS. 6*a* and 6*b* schematically show gaming arrangements comprising plural gaming systems.
Figure 6B:
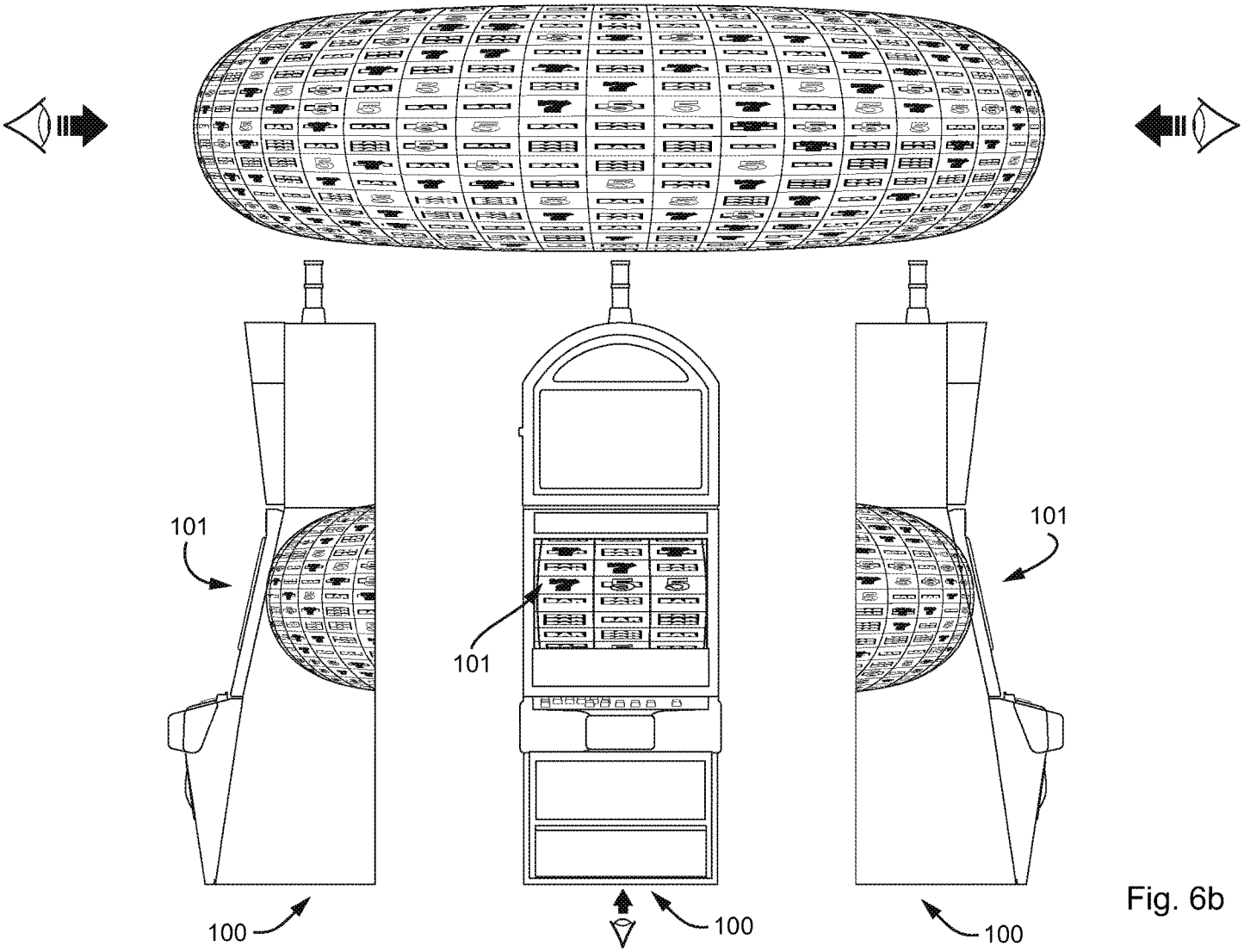

FIGS. 6*a* and 6*b* both schematically show gaming arrangements comprising plural gaming systems 100. In the arrangement of FIG. 6*a* which provides a top view of such an arrangement eight gaming systems 100 are interconnected. FIG. 6*b* provides a side view of such an arrangement with only three visible gaming systems 100 to keep the figure clear. While interconnection of gaming systems by itself is well-known, the interconnection in accordance with the invention certainly is not.

In accordance with the invention, the interconnected gaming machines each present in their respective display areas a share of the same spherical object, rather than separate objects. The plural gaming systems in this arrangement each display their own respective win line presenting an arrangement of a plurality of symbols in particular patterns to provide a winning outcome.

The display areas 101 of the plural systems 100 are provided on the front of the systems 100. In another embodiment one may install additional display areas on the sides of the systems 100 to increase the visibility and recognizability of the spherical objects employed. The symbols shown in each of the four display areas 101 are all present on a single spherical object 103*a*, shown schematically in FIG. 6*a* as an overlapping torus on the systems 100. Each player has his or her own view on the spherical object 103*a* and thus his or her own chances of obtaining a winning combination along at least one win line.

However, the invention does not just provide a way to share a spheroid object among players. This multi-system arrangement provided by the invention allows a single player to play on plural interconnected systems at the same time. In this arrangement, symbols on a spheroid object that rotate away outside the view of one display area on one gaming system now will appear on a display area of another gaming system. This creates the impression for players that by careful manipulation of the rotation of the objects, including the use of hold buttons 104*a*, 104*b*, 104*c*, they can cause winning combinations of symbols to appear in some or all of the display areas. This greatly encourages game play.

In an embodiment the arrangement provides that at least some of the at least one win lines run through plural display areas. Because a shared spheroid object is used, this embodiment is easy to implement—the results for all win lines on all systems 100 can be evaluated easily by examining the one spheroid object. This embodiment of the invention can however be extended with multiple spheroid objects all shared among the multiple gaming systems 100.

The above provides a description of several useful embodiments that serve to illustrate and describe the invention. For the sake of brevity, well-known methods, procedures, components, and circuits have not been described in detail. The description is not intended to be an exhaustive description of all possible ways in which the invention can be implemented or used. The skilled person will be able to think of many modifications and variations that still rely on the essential features of the invention as presented in the claims. Moreover, parts of the processing of the present invention may be distributed over multiple computers or processors for better performance, reliability, and/or cost.

The above-disclosed gaming system 100 can be implemented by adding a computer program product that provides the relevant functionality to an existing gaming system. Such a computer program product is a collection of computer program instructions stored on a computer readable storage device for execution by a computer. These instructions may be in any interpretable or executable code mechanism, including but not limited to scripts, interpretable programs, dynamic link libraries (DLLs) or Java classes. The instructions can be provided as complete executable programs, as modifications to existing programs or extensions ("plugins") for existing programs.

The computer program product may be provided to the gaming system recorded on a machine-readable storage device. Machine-readable storage devices suitable for storing computer program instructions include all forms of non-volatile memory, including by way of example semiconductor memory devices, such as EPROM, EEPROM, and flash memory devices, magnetic disks such as the internal and external hard disk drives and removable disks, magneto-optical disks and CD-ROM disks. The computer program product can be distributed on such a storage device, or may be offered for download through HTTP, FTP or similar mechanism using a server connected to a network such as the Internet. Transmission of the computer program product by e-mail is of course also possible. To this end one may connect a server system comprising the storage medium discussed above to a network, and arrange this server for allowing the instructions to be downloaded to client systems connected directly or indirectly to the network.

The computer program product can also be offered in a web-based version, where the actual program instructions reside on a server that connects to a client system via the World-Wide Web or a similar network, allowing a player to interact with the computer program product via the client system. This has the advantage that the program product can reside on one server and be used by multiple players at multiple client systems. Furthermore, the player does not have to visit a casino but can instead play from the comfort of his home.

When constructing or interpreting the claims, any mention of reference signs shall not be regarded as a limitation of the claimed feature to the referenced feature or embodiment. The use of the word "comprising" in the claims does not exclude the presence of other features than claimed in a system, product or method implementing the invention. Any reference to a claim feature in the singular shall not exclude the presence of a plurality of this feature. The word "means" in a claim can refer to a single means or to plural means for providing the indicated function.

The invention claimed is:

1. A gaming system comprising:

a display area;

a toroidal object having a surface thereof which defines a closed path encircling a hole of the toroidal object, wherein the toroidal object is provided with a plurality of symbols on the surface thereof including symbols on the closed path encircling the hole, a gaming controller for causing the toroidal object to rotate along at least three separate axes of rotation, a display device for displaying symbols provided on a part of the surface of the toroidal object when rotated by the gaming controller in the display area of the gaming system, and a win determinator for evaluating a winning condition from those symbols of the toroidal object that are visible in the display area along at least one win line.

2. The gaming system of claim 1, comprising:

at least two toroidal objects, the respective surfaces of which are provided with respective pluralities of symbols, wherein the gaming controller is configured for causing each of the toroidal objects to rotate along at least three separate axes of rotation, and wherein the display device is configured for displaying symbols provided on a part of each of the toroidal objects as rotated by the gaming controller in the display area, and wherein the win determinator is configured for evaluating a winning condition from those symbols of each of the toroidal objects that are visible in the display area along the at least one win line.

3. The gaming system of claim 1, wherein the toroidal object is embodied as a virtual object stored in computer memory, and wherein the gaming system comprises a rendering system for displaying on the display area a computer-generated visualization of the object.

4. The gaming system of claim 3, wherein the display device comprises a symbol adjustment controller for adjusting an orientation of the symbols on the displayed part of the toroidal object relative to the rotation caused by the gaming controller.

5. The gaming system of claim 1, at least one of the at least three separate axes is an axis of revolution of the toroidal object.

6. A gaming arrangement comprising plural gaming systems and a toroidal object having a surface thereof which is provided with a plurality of symbols, wherein each gaming system comprises:

a display area;

a gaming controller for causing the toroidal object to rotate along at least three separate axes of rotation, a display device for displaying symbols provided on a part of the surface of the toroidal object when rotated by the gaming controller in the display area of the gaming system, and a win determinator for evaluating a winning condition from those symbols of the toroidal object that are visible in the display area along at least one win line, and wherein each display area of each of the plural gaming systems presents a different part of the toroidal object of the plural gaming systems.

7. The gaming arrangement of claim 6, where at least some of the at least one win line runs through a respective display area of at least one of the plural gaming systems.

8. An apparatus for playing a game, the apparatus comprising:

a display;

user controls; and a processing system coupled to the display and the user controls, the processing system including at least one processor and being configured to at least:

display, on the display, a toroidal object having a surface thereof which defines a closed path encircling a hole of the toroidal object, wherein the toroidal object is provided with a plurality of symbols on the surface thereof including symbols on the closed path encircling the hole, and the toroidal object is rotatable along three axes of rotation;

based on an input made to the user controls, control the displayed toroidal object to rotate along one or more of the three axes of rotation for a period of time and display, on the display, symbols provided on a part of the surface of the toroidal object; and evaluating a winning condition based on one or more of the displayed symbols of the toroidal object that are visible along at least one win line.

9. The apparatus of claim 8, wherein the processing system is configured to simultaneously display, on the display, a plurality of toroidal objects.

10. The apparatus of claim 8, wherein processing system is configured to control the toroidal object to rotate along each of the three axes of rotation sequentially for at least a portion of the period of time.

11. The apparatus of claim 8, wherein the symbols are distributed over the surface of the toroidal object as strips that do not coincide with the axes of rotation.

* * * * *